US005249708A

United States Patent [19]

Magness

[11] Patent Number: 5,249,708

[45] Date of Patent: Oct. 5, 1993

[54] CONTAINER PUNCTURE SPOUT

[76] Inventor: Thomas Magness, 722 Sharon Ave., Collingdale, Pa. 19023

[21] Appl. No.: 947,545

[22] Filed: Sep. 21, 1992

[51] Int. Cl.[5] ..... B67B 7/24

[52] U.S. Cl. ..... 222/83; 222/81; 222/80; 222/89

[58] Field of Search ..... 222/89, 81, 83, 85, 222/86

[56] References Cited

U.S. PATENT DOCUMENTS

| | | | |
|---|---|---|---|
| 2,552,154 | 5/1951 | Danielson | 222/81 |
| 2,552,155 | 5/1951 | Danielson | 222/81 |
| 2,585,538 | 2/1952 | Daniels | 222/81 |
| 2,598,843 | 6/1952 | Sherwood | 222/83 |
| 3,285,472 | 11/1966 | Olson | 222/86 |
| 3,964,640 | 6/1976 | Laughlin | 222/81 |
| 4,271,983 | 6/1981 | Takemura et al. | 222/85 |
| 4,723,689 | 2/1988 | Vallos et al. | 222/83 X |
| 4,846,369 | 7/1989 | Dunstan | 222/85 X |
| 4,881,662 | 11/1989 | Tallman | 222/81 |
| 4,964,536 | 10/1990 | Vestering | 222/83 |
| 5,020,690 | 6/1991 | Kishikawa et al. | 222/83 |

FOREIGN PATENT DOCUMENTS

| | | | |
|---|---|---|---|
| 645279 | 7/1962 | Canada | 222/81 |
| 113053 | 2/1969 | Denmark | 222/81 |

*Primary Examiner*—Andres Kashnikow
*Assistant Examiner*—Lesley D. Morris
*Attorney, Agent, or Firm*—CTC & Associates, Inc.

[57] ABSTRACT

An improved self-contained puncture spout for ridge-seal gable containers which wedgedly engages the ridgeseal to hold it in place in proper orientation to the gable top.

1 Claim, 2 Drawing Sheets

CONTAINER PUNCTURE SPOUT

BACKGROUND OF THE INVENTION

Wax or polymer coated paperboard gable top or ridgeseal containers have frustrated the user since their inception many years ago. This frustration eminates because the heat sealing mechanism to close the top often is improperly set thereby resulting in complete penetration of the wax or polymer coating into the porous paperboard and thus to fuse into one mass. When the user attempts to separate or open the container they literally must tear into the fused mass. This results in distorted, ragged edges on the pour spout formed by opening the container which act to spray the fluid being decanted or poured from the container not only into a waiting receptacle but onto an area adjacent to the receptacle. In addition, the opened container cannot effectively be resealed to prevent spillage of the container's contents when the container is tilted for example to place the same on a refrigerator shelf. Perhaps more importantly the remaining contents in the container tend to spoil much more rapidly because of contact with air.

This problem has been recognized by some brands of milk, juice and the like because they have developed a threaded opening/closing cap system mounted on the center point of one of the gables which eliminates the need to break the ridgeseal. This cap system appears to be giving those brands using the concept a marketing advantage albeit a costly advantage since it appears they cannot charge the consumer for the convenience, i.e. they will sell more container content but at a higher packaging cost. The improved container puncture spout of this invention eliminates the need for such cap closure and overcomes the problem of the fused ridgeseal.

OBJECT OF THE INVENTION

It is an important object of the invention to provide the consumer a simple non-splattering means to decant or pour the content of paperboard ridgeseal containers.

It is another important object of the invention to provide a non-spill spout through which to pour container contents.

It is yet another important object to provide a spout with a sealing means to reseal a container to prevent exposure to the air of the remaining partially decanted contents.

PRIOR ART

A preliminary search for patentability conducted at the U.S. Patent Office revealed the following prior art:

| Patent Number | Inventor | Issue Date |
|---|---|---|
| 2,552,154 | Danielson (1) | May 8, 1951 |
| 2,552,155 | Danielson (2) | May 8, 1951 |
| 2,585,538 | Daniels | February 12, 1952 |
| 2,598,843 | Sherwood | June 3, 1952 |
| 4,881,662 | Tallman | November 21, 1989 |

Danielson (1) teaches a valve spout cream remover which is of one piece for puncturing a carton's sidewall at any desired position for draining the liquid down to the position of the device.

Danielson (2) teaches a valve spile that may readily be pushed through the sidewall of a container for allowing liquids to be dispensed.

Daniels teaches a device for tapping liquid-containing cartons for the purpose of withdrawing selectively variable portions of the contained liquid.

Sherwood teaches a pouring device with stopper means for a combined liquid container.

Tallman teaches a multi-component resealable dispensing spout or pouring device which has a threadable means to thread the spout into a container wall.

SUMMARY OF THE INVENTION

In its simplest form the improved container puncture spout of the invention is an assembly of a tubular puncture spout mounted within a collar or flange. The collar or flange acts first to seal the puncture tube to the container to prevent leakage of the material contained therein by use of a gasket of a skinned, molded closed cell soft cellular elastomeric material such as flexible PVC; any one of a number of cured rubbers such as compounded natural rubber, styrenebutadine, neoprene, epdm and the like or thermoplastic elastomers such as styrene butadine styrene block polymers, partially crosslinked epdm/polypropylene TPE, high polyethylene/propylene- co-polymers and the like. The collar or flange also has a retainer slot which wedgedly interlocks with the container ridgeseal and prevents overly deep penetration of the puncture spout into the container and frictionally wedge locks and positions the collar onto the ridgeseal gable or angular container top. The tubular spout has at one end a sharp penetrating point which may be described as an arcuately truncated tube being truncated to a point. The arcuate edges are sharp so as to slice through the polymer coated paperboard without developing ragged edges. The opposite end of the tubular member being bent in an obtuse angular manner in relationship to the tubular member's axis to form a spout. The end of the spout also may have a flapper or other cover to protect the contents remaining in the container.

In use, the improved container spout is inserted into the angular top of a ridgeseal gable container by grasping the obtuse angular spout in such manner that the penetrating end is pressed downward onto one of the angular top gable container members to penetrate the polymer coated board, continuing pressure while simultaneously rotating the spout so as to cut a disk therefrom. The improved container puncture spout is then withdrawn and the paperboard disk is removed. Subsequently, the spout is reinserted into the hole in the angular gable top aligning the ridgeseal retainer slot so that it interlocks with the container's ridgeseal. Pressure is applied until the wedge retainer slot wedgedly locks in place thereby compressing the blown closed cell elastomeric gasket in place. Thus aligning the spout for pouring and sealing the improved puncture spout in place. An air breathing tube may be made part of the puncture spout to prevent vacuum formation in the container as liquid is poured therefrom. Alternatively the puncture of the angular able top opposite that in which the puncture spout is mounted with a pin or needle will permit the container to breathe.

Although the primary usefulness of the improved puncture spout will be for liquid containers such as milk, cream or juice it is also useful for similar containers containing granular or powdered products such as dried onion chips, breadcrumbs and the like.

DETAILED DESCRIPTION

Figure 1:
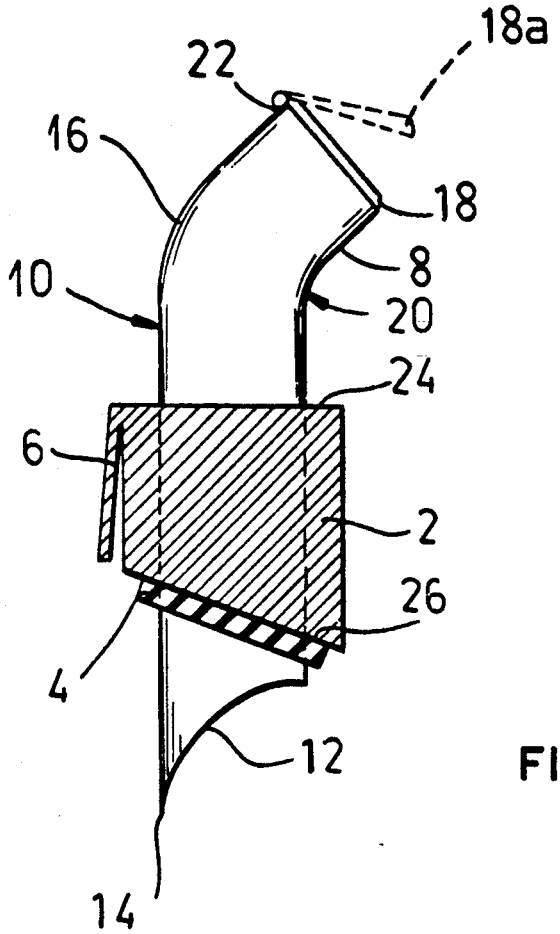
FIG. 1 is a side view of the improved puncture container spout.
Figure 2:
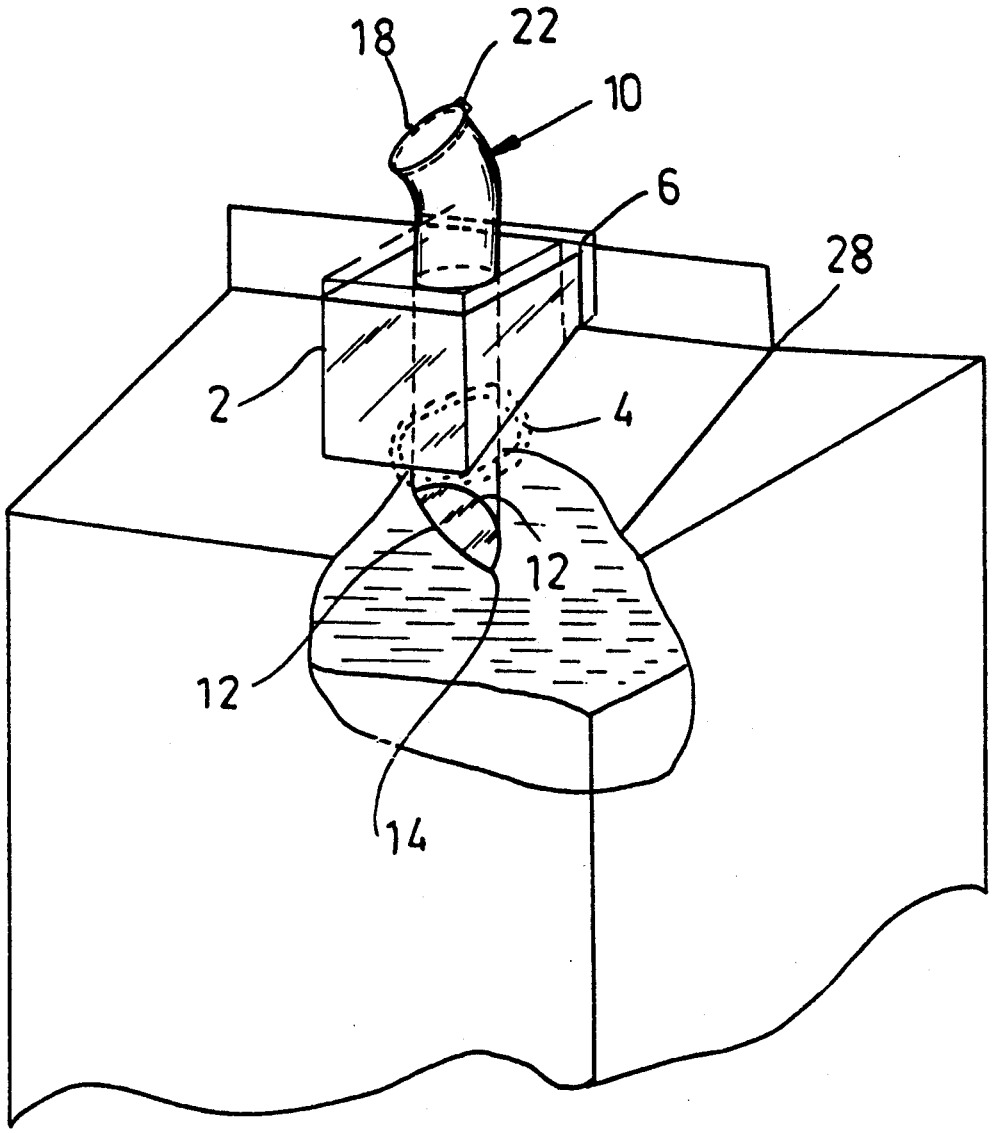
FIG. 2 is a perspective view of the improved puncture container spout in place on and in the ridgesealed container.

Improved puncture container spout 10, FIG. 1 is composed of tubular member 16, flange or collar 2 and flexible closed cell cellular gasket 4.

Tubular member 16 has two ends the first of which is arcuately truncated to a container top penetrating point 14. Arcuate edges 12 are sharpened to a knife edge to cleanly cut the polymer coated paperboard container. The second end of tubular member 16 is bent into an obtuse "L" shape in relationship to the axis of the angle 20 of tubular member 16 being not less than 100° nor more than 160° but preferably in the range of 135°. The second bent end of tubular member 16 is truncated at 90° to the axis of the bent portion. A flapper cover 18 is hingedly affixed to said tubular member with hinge member 22. Flapper cover is shown in partially open position in phantom 18*a*. A threaded or snap fit cover (not shown) may also be utilized to cover the spout.

Tubular member 16 is mounted within collar 2, the collar having a first upper edge 24 which is essentially perpendicular to the axis of tubular member 16. Second lower edge 26 is angled so as to conform to the angle of the ridgeseal container top which may vary from 30° to 45° and is in contact with skinned closed cell foam gasket 4 which has sufficient thickness and resilience so that it may be compressed to overcome the disparity in container angle 28. The skinned closed cell foam gasket has a low compression modulus so as to require very little force to conform to the angled gabled container top to effect a liquid seal.

Compression modulus being defined in ASTM 1565 as "Flexible foams made from polymers or copolymers of vinyl chloride" Indention-Load Deflection Test. In this procedure an indentor foot is used to apply pressure on an area of 3.2 $dm^2$ (50 $in^2$). The load or force required to deflect the foam is known as its compression modulus. The preferred range for the compression modulus for the collar of the instant invention is between 23–46N/3.2 $dm^2$ (5–10 lbs/50 $in^2$). Foams of greater or lesser load deflection values do not effect the required seal.

Collar 2 also has a wedge shaped retainer slot 6 at its third or rear edge or shorter side which fits over and wedgedly engages the ridgeseal of the gable container to lock the puncture spout and collar to the container as the device is pushed into place on the container.

The exterior shape of flange or collar 2 may be round, triangular, rectangular or square and thus a matter of choice in final design. The interior dimensions of tubular member 16 conforms to the exterior circumferential dimensions of the tubular member minus the thickness of the wall of the tubular member.

The disclosed details are explanatory only and are not to be taken as limitations on the invention except as these details may be included in the appended claims.

What is claimed is:

1. An improved puncture spout for ridgeseal gable containers, said ridgeseal gable containers having two angular tops, the improvement of said puncture spout comprises a tubular member and a collar surrounding said tubular member, said tubular member having two ends, the first of said ends is arcuately truncated to form two edges and a container top penetrating point, said two edges being sharp so as to cleanly cut one of said two angular gable container tops, the second end of said tubular member being formed into an obtuse angle in relationship to the axis of said tubular member to form a pouring spout, said pouring spout having a sealing member mounted thereon, said collar having a first upper edge, a second lower edge, a third rear edge and a fourth front edge, said first upper edge being perpendicular to the axis of said tubular member inserted therein, said second lower edge of said collar is angled to generally conform to an angular top of the gable container said third rear edge of said collar having a wedge shaped slot to interlock with said gable container ridgeseal; said second lower edge of said collar having a low compression modulus closed celled foam gasket affixed thereto located on said tubular member adjacent to said second lower collar edge, said gasket sealing against said angular top of said gable container and said collar when said sharp arcuate edges and point are inserted into said container and said rear edge wedge slot of said collar interlocks onto said ridgeseal of said container the improved puncture spout permitting the pouring of said container's contents.

* * * * *